US006996855B1

(12) United States Patent
Dandrea

(10) Patent No.: US 6,996,855 B1
(45) Date of Patent: Feb. 14, 2006

(54) MARTIAL ARTS BELT

(76) Inventor: Steven Dandrea, 19 Reservoir Dr., Wanaque, NJ (US) 07465

( * ) Notice: Subject to any disclaimer, the term of this patent is extended or adjusted under 35 U.S.C. 154(b) by 0 days.

(21) Appl. No.: 10/746,638

(22) Filed: Dec. 29, 2003

(51) Int. Cl.
*A41F 3/02* (2006.01)

(52) U.S. Cl. ..... 2/338

(58) Field of Classification Search ..... 2/919, 2/920, DIG. 11, 311, 16, 22, 24, 312–319, 2/320–322, 326, 336, 338, 171, 144, 148, 2/151, 154, 156, 910; D2/624, 627, 629
See application file for complete search history.

(56) References Cited

U.S. PATENT DOCUMENTS 4,999,853 A * 3/1991 Tanner ..... 2/321
5,539,933 A * 7/1996 Garber et al. ..... 2/311
6,449,774 B1 * 9/2002 Michael ..... 2/311
6,532,600 B1 * 3/2003 Brignoli ..... 2/311

* cited by examiner

*Primary Examiner*—Tejash Patel
(74) *Attorney, Agent, or Firm*—Thomas L. Adams

(57) ABSTRACT

A martial arts belt sized to fit around a user's waist has a strap with a pair of strap sections. Each strap section has a fastening end and a tie end. The strap sections join together at a juncture located between the fastening end and the tie end of each strap section. The strap sections each have between the juncture and the fastening end of each strap section, posterior fastening devices for fastening the strap sections together behind a user's waist. Portions between the juncture and the tie end of each of the strap sections are tied into an anterior knot having dependent tails. An insignia patch can be removably secured at one of the tails for later removal or repositioning.

15 Claims, 1 Drawing Sheet

MARTIAL ARTS BELT

BACKGROUND OF THE INVENTION

1. Field of the Invention

The present invention relates to martial arts belts and methods for using the same.

2. Description of Related Art

The loose jacket (gi, dogi, or dobak) worn by martial arts participants is cinched by a traditional cloth belt tied with a specified knot. The training and customs of martial arts requires the participant to wrap this belt around the waist once or twice before tying the belt in the traditional knot. For novices, especially children, properly tying the traditional knot is difficult. Classroom training is often disrupted when a knot comes undone either normally or because of improper tying. When training a class of children, an instructor is continually interrupted by the need to help students retie their knots. Participants tolerate this inconvenience since such customs and traditions are considered an important part of the ethic, discipline and training in the martial arts.

The martial arts belt in U.S. Pat. No. 6,532,600 (based on the published patent application U.S. 2002/0157171) employs a pre-tied knot 12 secured to a short section 31 of belt material that is then stitched or glued to one end of a long belt 18. Belt 18 is long enough to wrap twice around the waist and is secured by the Velcro® strips illustrated in FIGS. 2 and 3. See also U.S. Design Pat. No. D456,107.

In U.S. Pat. No. 5,539,933 a tying strap 26 can be attached to one end of a long belt 12 by stitching, gluing or by Velcro® fasteners. The long belt 12 can be wrapped about the waist and secured with Velcro® fasteners. A knot can be tied in the tying strap 26 and can remain tied as the long belt 12 is repeatedly removed and worn again. See also U.S. Design Pat. No. D282,789 ("black belt").

In U.S. Pat. No. 4,472,839 a cummerbund has two ends that are secured in the rear by Velcro® fasteners.

In U.S. Pat. No. 5,106,004 a belt with a watch in the front is secured in the back with Velcro® fasteners.

In U.S. Pat. No. 4,999,853 a belt is routed through a buckle to the inside of the belt and secured in place by Velcro® fasteners on the inside surface of the belt. The outside surface of the belt is decorative.

Accordingly, there is a need for an improved martial arts belt that is easily secured around a user's waist but still maintains the traditional appearance.

SUMMARY OF THE INVENTION

In accordance with the illustrative embodiments demonstrating features and advantages of the present invention, there is provided a martial arts belt sized to fit around a user's waist. The belt has a strap with a right and a left strap section. Each strap section has a fastening end. The right and the left strap section join at a juncture located between the fastening ends. The strap has a centrally located anterior knot. The right and the left strap sections each have at the fastening end of each a posterior fastening device for fastening the right and the left strap sections together around a user's waist.

In accordance with another aspect of the invention a martial arts belt sized to fit around a user's waist can hold at least one patch. The belt has a strap with two tie ends. The belt has a length sized to wrap around the user's waist, knot together, and leave two free tails at the tie ends. The strap has at one of its tie ends a first patch holding device.

In accordance with yet another aspect of the invention a method is provided for securing around a user's waist a martial arts belt having a pre-tied knot between two fastening ends. The method includes the step of placing the pre-tied knot on one side of the user's waist. Another step is routing the two fastening ends to the opposite side of the user's waist. The method also includes the step of fastening the two fastening ends to secure the belt around the user's waist.

In accordance with still yet another aspect of the invention, a method is provided for decorating a martial arts belt that has a pair of tails depending from an anterior knot. The method includes the step of fastening an insignia patch at one of the tails. Another step is removing the insignia patch.

In a preferred embodiment employing equipment and methods of the foregoing type, a belt has a pair of strap sections that can be secured behind the user's waist with fastening means such as Velcro® hook and loop fasteners. A pre-tied knot can be made in the front without showing a seam or gap that would detract from the traditional appearance. Also, placing the fastening means in the back leaves it less accessible and less prone to being undone if the overlapping ends of the fastening means should partially lift.

Preferably, the belt will be made from two distinct strap sections that are overlapped and stitched together at a juncture in such a way that each section will have a short and a longer length extending in opposite directions from the juncture. The shorter lengths can be tied together in a traditional knot and fixed by stitching, gluing or by other means. Since these shorter lengths come together with the usual orientation, the resulting knot has a natural appearance. The longer lengths can be fitted with hook and loop fasteners in order to be secured together to close the belt around a user's waist. These hook and loop fasteners are made relatively long to provide a relatively strong connection and to accommodate a relatively wide range of adjustment.

In one highly preferred embodiment, tails depending from the knot are fitted with hook and loop fasteners for attachment of various insignia. The insignia could indicate a level of achievement, a group or club affiliation, a product or service brand, a personal message or identification, and the like.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
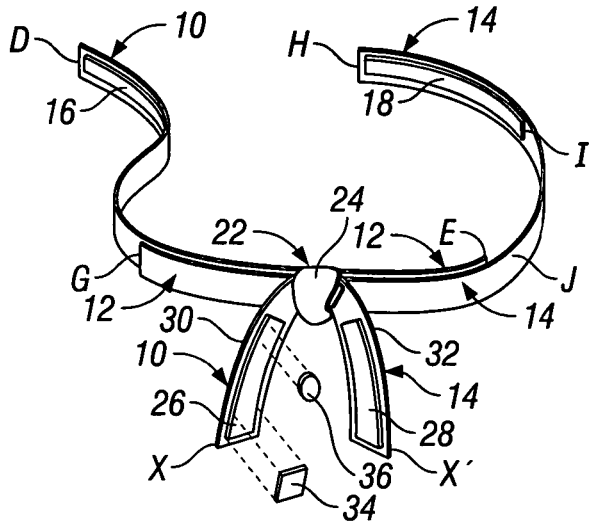
FIG. 1 is a perspective view of a martial arts belt in accordance with principles of the present invention.
Figure 2:
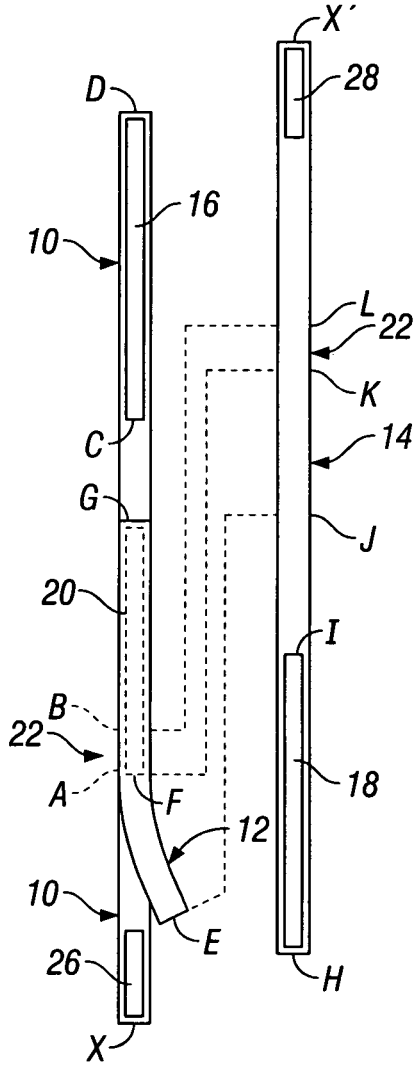
FIG. 2 is an exploded view of the belt of FIG. 1 showing the outside face of one strap section and the inside face of another strap section.

Referring to FIGS. 1–2 a martial arts belt is shown as a strap made of cloth or other material and having a right strap section 10 and a left strap section 14 of approximately the same length. Strap section 10 has a fastening end D and a tie end X. Strap section 14 has a fastening end H and a tie end X'. A posterior fastening device 16 is attached to the outside face of strap section in interval C-D. A posterior fastening device 18 is attached to the inside face of strap section 14 in interval H-I. The fastening devices 16 and 18 are preferably hook and loop fasteners (e.g., Velcro® fastening strips), although snaps, buckles, and other fastening means are possible. The preferred fastening devices 16 and 18 are relatively long, for example, at least 30 cm. This length ensures that a strong connection will exist between fastening devices 16 and 18 and also that the devices can be longitudinally adjusted and still maintain a significant overlap and therefore a strong connection.

In this embodiment, an intermediate strap 12 is attached along its interval F-G to strap section 10, so that location F of strap 12 overlies location A of strap section 10. Specifically, strap 12 is attached by stitching 20 laid along most of the interval A-C of strap section 10. Instead of stitching, in some embodiments elements 10 and 12 may be attached by glue, rivets, staples, or other means. The portion of interval F-G, excluding the portion overlying interval A-B of strap section 10, is herein referred to as a first portion. Interval F-E is herein referred to as a second portion of the intermediate strap 12. The interval between the first and second portion is herein referred to as the central portion of the intermediate strap 12.

Interval J-L of strap section 14 is attached to intermediate strap 12 with locations J and K of strap section 14 overlying locations E and F of strap 12, respectively. Location L of strap section 14 lies in the interval F-G, closer to location F, and overlying location B of strap section 10. Interval J-L of strap section 14 as visible in FIG. 2 is an inside face that is attached to the outside face of strap 12 that is visible in FIG. 2. The interval A-B of strap section 10 is attached not only to strap 12 but to the adjacent interval K-L of strap section 14. This triply attached section embraced by intervals A-B and K-L is herein referred to as the juncture 22. It will be appreciated that some embodiments may eliminate intermediate strap 12, in which case the juncture 22 will be formed by attaching interval A-B of strap section 10 directly to the corresponding interval K-L on strap section 14. As before, elements 10, 12, and 14 can be attached by stitches, although in some embodiments they may be attached by glue, rivets, staples, or other means.

Preferably, the length of interval B-D of strap section 10 is the same as interval K-H of strap section 14. This will ensure that the fastening location (the region where fastening devices 16 and 18 join) will be located posteriorly when the juncture 22 is located in front.

When elements 10, 12 and 14 are attached together in the above manner, interval B-D of strap section 10 and interval K-H of strap section 14 will project in opposite directions from juncture 22. Also, interval A-X of strap section 10 and interval L-X' of strap section 14 will project in opposite directions from juncture 22. Intervals A-X and L-X' are free and can be tied into a traditional knot 24 as shown in FIG. 1. Not all of intervals A-X and L-X' are consumed in knot 24 and the excess forms two dependent tails 30 and 32 that are shown depending from anterior knot 24. In preferred embodiments knot 24 will be pre-tied by the manufacturer and made permanent by means of stitching, glue, staples, or other means. However, in some instances the knot will remain loose so that students can practice tying and untying the knot.

Patch holding devices 26 and 28 are secured on one side (or both sides) of tails 30 and 32, respectively. In one embodiment devices 26 and 28 were rectangular strips of hook and loop fasteners that were stitched or glued to tails 30 and 32. Holding devices 26 and 28 are designed to hold insignia patches. For example, in FIG. 1 insignia patches 34 and 36 are shown about to be attached to holding device 26. Patches 34 and 36 will have hook and loop fasteners designed to mate with that of holding device 26.

The insignia patches may indicate the rank of the user or signify some achievement. Alternatively, the patch can signify membership in some group or club. In still other embodiments, the patches may have the user's name or other identifying material. In still yet other embodiments, the patches may be decorative or contain advertising information. Advantageously, patches 34 and 36 can be easily removed when no longer appropriate. The patches can also be easily repositioned to accommodate other patches or simply to satisfy the user's whim for a new arrangement. It will be appreciated that patch holding device 28 can be used in a similar fashion.

Figure 3:
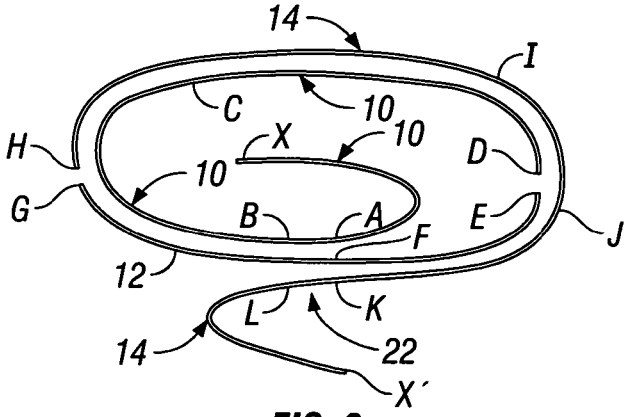
FIG. 3 is a schematic illustration showing the relative location of portions of the belt of FIGS. 1 and 2.
Figure 4:
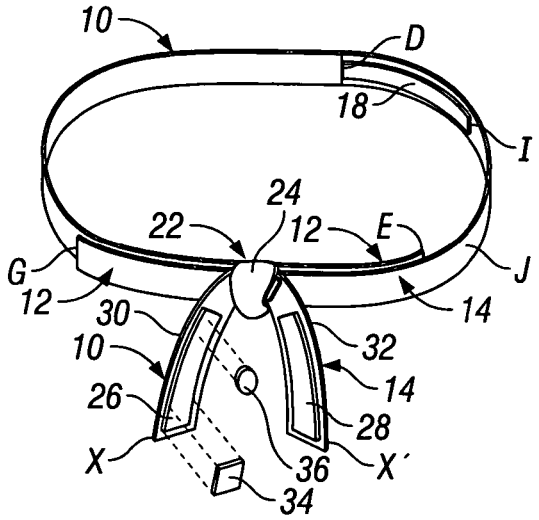
FIG. 4 is a perspective view of the martial arts belt shown in FIG. 1 in a fastened condition.

Referring to FIG. 3, previously mentioned elements 10, 12, and 14 are shown schematically in an unassembled condition. These elements are laid out in approximately the position they would occupy when worn by a user, with the exception that the tie ends A-X and L-X' are hanging loosely and are not tied in a knot. When laid out in this fashion ends G and H are almost abutting, as is the case with ends D and E.

This diagram shows that elements 10–14 would be wrapped around a user's waist much like the way a traditional martial arts belt would wrapped. In particular, this diagram shows that the belt structure of FIG. 3 closely simulates a single belt being wrapped twice around a user's waist. In fact, in some embodiments the belt structure can be made by twice wrapping a belt and then cutting the belt at the breaks shown in FIG. 3. Moreover, because the belt structure closely mimics a normal layout, a knot tied with tie ends A-X and L-X' will have a very natural and traditional appearance. In fact, except for any gap that may be exist between ends G and H, the present belt will look almost identical to a traditional belt.

To facilitate an understanding of the principles associated with the foregoing apparatus, its operation will be briefly described. The manufacturer will typically provide the present belt in the condition shown in FIG. 1. To don the belt the user may place the knot 22 in front and place the fastening end D in back. The fastening end H can then be placed in back so that fastening device 18 overlays fastening device 16. Alternatively, the user may place knot 22 in back, fastening the devices 16 and 18 in front before turning the belt around 180°. The manner and extent of overlap is adjustable to accommodate users of different girth.

The foregoing avoids the need to tie knot 22. Also, there is no concern that during an exercise the knot 22 will become undone. Knot 22 is secured by stitches or other fixing means; but regardless, knot 22 is not the effective means for keeping the belt closed and therefore cannot be the reason for the belt coming loose. Accordingly, instructors will not be distracted by a need to assist students, particularly young students, with retying their belts.

Moreover, the belt is held together securely by relatively long fastening devices 16 and 18. Therefore even during vigorous exercise the belt will not tend to come undone.

Before or after donning the belt the user may secure insignia patches 34 and 36 to holding devices 26 or 28. For example, if the user has achieved a certain level of proficiency he or she may be awarded insignia patches to signify this level of accomplishment. The insignia patches could also indicate an award received in competition. Alternatively, the patch may be used to identify an instructor, an assistant, a novice, etc. In addition, the insignia may be used to display the user's name, the name of a gym or club, or other association. Also, the insignia patches are easily removed, replaced or rearranged since they are held in place by hook and loop fasteners.

It is appreciated that various modifications may be implemented with respect to the above described, preferred embodiments. For example, instead of using hook and loop fasteners, in some embodiments the insignia patches can be held by snaps, clear plastic pockets, zippers, clips, and the like. The same variety can be employed with regard to the fastening device used to hold the belt together around the user's waist. Also, the illustrated belt can be made of various lengths and widths depending upon the size and other needs of the user. While traditional cloth is preferred, various types of non-traditional knitted or woven fabrics may be used, as well as synthetic webs, hides, composite materials, etc. Also, some embodiments may employ the insignia holding devices 26 and 28 but not the posterior fastening devices 16 and 18, or vice versa. Also, instead of one continuous fastening strip, the illustrated fasteners can be made in separate discrete sections. Alternatively, a combination of fasteners may be used; such as: hook and loop fasteners combined with buckles or snaps. Moreover, some elements are shown as one continuous band but may in some embodiments be composed of serially interconnected elements, overlapping elements, or composite elements. While certain elements are illustrated with a right-handed or left-handed aspect, this chirality can be altered in alternate embodiments.

Obviously, many modifications and variations of the present invention are possible in light of the above teachings. It is therefore to be understood that within the scope of the appended claims, the invention may be practiced otherwise than as specifically described.

The invention claimed is:

1. A martial arts belt sized to fit around a user's waist, comprising:

a strap having a right and a left strap section, each strap section having a fastening end, said right and said left strap section being overlapped and joined at a juncture located between and longitudinally spaced from the fastening ends, said strap having a centrally located anterior knot, said right and said left strap sections each having at the fastening end of each a posterior fastening device for fastening said right and said left strap sections together around a user's waist at a position longitudinally spaced from said juncture, the fastening device of said right and said left strap sections being arranged to bring said right and said left strap sections together while precluding either from returning back to said juncture.

2. A martial arts belt according to claim 1, wherein said right and said left strap sections each have opposite said fastening end a tie end, said right and said left strap sections being attached together at the juncture with one facing outwardly and the other facing inwardly, the juncture being located between the fastening end and the tie end of each of said right and said left strap sections, portions between the juncture and the tie end of each of said right and said left strap sections being knotted together from oppositely facing sides of said juncture to form said knot.

3. A martial arts belt according to claim 1 wherein the fastening devices of said right and said left strap sections are operable to fasten together at a fastening location to form a loop of an adjustable size, said fastening location being opposite said juncture.

4. A martial arts belt according to claim 1 wherein the fastening devices comprise hook and loop fasteners.

5. A martial arts belt according to claim 4 wherein the fastening devices are each at least 30 cm long.

6. A martial arts belt according to claim 1 wherein portions between the juncture and the tie end of each of said right and said left strap sections are knotted and fixed to prevent untying during normal use.

7. A martial arts belt according to claim 2 wherein portions between the juncture and the tie end of each of said right and said left strap sections are knotted and stitched to prevent untying during normal use.

8. A martial arts belt according to claim 7 wherein said right and said left strap sections are stitched together at said juncture.

9. A martial arts belt according to claim 8 wherein said right and said left strap sections are substantially the same length.

10. A martial arts belt according to claim 2, comprising:

an intermediate strap having a pair of ends distinct from the fastening ends and being sandwiched between said right and said left strap sections at said juncture to provide additional thickness consistent with a traditionally tied, single length martial arts belt.

11. A martial arts belt according to claim 10 wherein said intermediate strap has (a) a first portion secured to said right strap section but not said left strap section, (b) a second portion secured to said left strap section but not said right strap section, and (c) between said first portion and said second portion a central portion secured to said right and said left strap sections at said juncture.

12. A martial arts belt according to claim 1 wherein said knot has a pair of dependent tails, the belt comprising:

at least one patch removably secured to one of said dependent tails.

13. A martial arts belt according to claim 1 comprising:

at least one patch removably secured by hook and loop fastening to one of said dependent tails.

14. A martial arts belt according to claim 1 wherein one of said dependent tails has a patch holding device.

15. A martial arts belt according to claim 1 wherein both of said dependent tails has a patch holding device.

* * * * *